US006688031B2

(12) United States Patent
Steele

(10) Patent No.: US 6,688,031 B2
(45) Date of Patent: Feb. 10, 2004

(54) REPLACEMENT ADJUSTABLE COMPETITION BUTTSTOCK

(76) Inventor: Gerald Dale Steele, 2263 Ironstone Dr. E., Jacksonville, FL (US) 32246

( * ) Notice: Subject to any disclaimer, the term of this patent is extended or adjusted under 35 U.S.C. 154(b) by 0 days.

(21) Appl. No.: 10/446,405

(22) Filed: May 28, 2003

(65) Prior Publication Data

US 2003/0221352 A1 Dec. 4, 2003

Related U.S. Application Data

(60) Provisional application No. 60/384,898, filed on May 30, 2002.

(51) Int. Cl.[7] ..... F41C 23/14
(52) U.S. Cl. ..... 42/73; 42/97; 42/71.01
(58) Field of Search ..... 42/73, 74, 71.01, 42/71.02, 72, 97

(56) References Cited

U.S. PATENT DOCUMENTS

| | | | | | |
|---|---|---|---|---|---|
| 404,921 | A | * | 6/1889 | Miller | 42/71.01 |
| 1,560,840 | A | * | 11/1925 | Molloy | 42/71.01 |
| 1,847,777 | A | * | 3/1932 | Morgan | 42/73 |
| 2,956,343 | A | * | 10/1960 | Shaffer | 33/506 |
| 4,006,548 | A | * | 2/1977 | Vignini | 42/97 |
| 4,127,953 | A | * | 12/1978 | McBride | 42/97 |
| 4,296,566 | A | | 10/1981 | Campos | 42/71 |
| 4,532,730 | A | * | 8/1985 | Hyytinen | 42/73 |
| 4,663,876 | A | | 5/1987 | Reaume | 42/71.01 |
| 4,663,877 | A | * | 5/1987 | Bragg | 42/74 |
| 4,869,008 | A | | 9/1989 | Rasmussen | 42/71.01 |
| 4,896,446 | A | * | 1/1990 | Gregory | 42/73 |
| 4,910,904 | A | * | 3/1990 | Rose | 42/74 |
| 5,001,855 | A | | 3/1991 | Griggs | 42/74 |
| 5,031,348 | A | * | 7/1991 | Carey | 42/74 |
| 5,367,812 | A | | 11/1994 | Lautrec | 42/74 |
| 5,392,553 | A | * | 2/1995 | Carey | 42/73 |
| 5,410,833 | A | * | 5/1995 | Paterson | 42/73 |
| 5,752,339 | A | * | 5/1998 | Bentley et al. | 42/74 |
| 5,970,642 | A | | 10/1999 | Martin | 42/73 |
| 6,311,423 | B1 | | 11/2001 | Graham | 42/74 |
| 6,560,911 | B2 | * | 5/2003 | Sharp | 42/73 |

* cited by examiner

*Primary Examiner*—Michael J. Carone
*Assistant Examiner*—Denise J Buckley
(74) *Attorney, Agent, or Firm*—Bruce E. Harang

(57) ABSTRACT

An ergonomic adjustable gun stock for AR-15, M-16, and SR-25 type rifles for use in competition shooting events, having multiple cheek pieces, and adjustable length of pull, weight, drop, and cant. The gun stock being mounted using the original gun stock mounting means without modification after removal of the original gun stock.

8 Claims, 5 Drawing Sheets

REPLACEMENT ADJUSTABLE COMPETITION BUTTSTOCK

This application claims the benefit of the filing date of co-pending provisional patent application Ser. No. 60/384,898 filed on May 30, 2002 under 35 U.S.C. 119(*e*).

FIELD OF THE INVENTION

This invention relates generally to gun buttstocks, and more particularly to an ergonomic adjustable gun stock for AR-15, M-16, and SR-25 type rifles for use in competition shooting events, having multiple cheek pieces, and adjustable length of pull, weight, drop, and cant.

BACKGROUND OF THE INVENTION

Conventional gun buttstocks for rifles are rearward diverging and rounded top and bottom in design and have a comb or cheek piece mounted on the upper portion of the buttstock, and a recoil butt plate or putt pad mounted on the rear lend of the buttstock.

A problem with the rearward diverging rounded top and bottom surfaces of the conventional buttstock is that the angularly inclined top surface is fixed relative to the butt plate. In order to aim the rifle, the shooter places the butt plate against his shoulder and rests his cheek on the angular top surface of the buttstock. Since the top surface extends angularly upward toward the butt plate at a fixed angle, the angular top surface of the buttstock on which the shooter rests his cheek may not comfortably fit or accommodate the shoulder, head and neck of the shooter. Thus, the shooter must often use the muscles of the head, neck and shoulder to properly position their cheek on the buttstock. An additional problem is that the shooter can not change the shape of the cheek area of the conventional buttstock to accommodate different firing positions.

A problem with the conventional recoil butt plate or butt pad is that it is removably secured to the rear end of the buttstock with screws and must be completely removed and replaced with a different size plate or pad to properly fit the arm length of a particular shooter or in situations where a shooter may put on or remove a heavy jacket. A further problem is that the recoil butt plate or butt pad can not be adjusted for drop or can only be changed with difficultly.

Another problem with the conventional buttstock is that the length of the buttstock can not be changed to accommodate different shooters and/or different shooting positions. While there are known length adjustable buttstocks they do not also incorporate the other features so desirable in competition rifle shooting.

Yet another problem with conventional buttstocks is that they do not allow for the easy and rapid changing of weight to allow for proper rifle balance for different shooters and different shooting positions.

Additionally, conventional buttstocks, and the heretofore known adjustable buttstocks do not allow for the attachment of the buttstock to the rifle receiver without modifications to the receiver to maintain the proper operation of the rifle.

For example U.S. Pat. No. 4,296,566 issued Oct. 27, 1981 to Campos teaches an arm or shoulder adjustable attachment to add to a conventional gun stock.

U.S. Pat. No. 4,663,876 issued May 12, 1987 to Reaume teaches a folding gun stock assembly.

U.S. Pat. No. 4,869,008 issued Sep. 26, 1989 to Rasmussen teaches a replacement gun stock which allows for the forward offhand to be used to actuate the trigger mechanism on a rifle or shotgun.

U.S. Pat. No. 5,001,855 issued Mar. 26, 1991 to Griggs teaches an adjustable recoil pad mounting device which allows for redirecting the direction of the recoil force of a rifle.

U.S. Pat. No. 5,367,812 issued Nov. 29, 1994 to Lautree teaches an extension tube mechanism allowing only for changing the effective length of a gun stock.

U.S. Pat. No. 5,970,642 issued Oct. 26, 1999 to Martin teaches an adjustable gun stock including an extended length forearm.

U.S. Pat. No. 6,311,423 issued Nov. 6, 2001 to Graham teaches a resistance adjustable gun stock recoil pad.

There still remains the need for an adjustable buttstock which provides for effectively providing the adjustment options required for effective competition shooting without the need for modifications to the receiver of the rifle to allow proper attachment and use of the weapon.

SUMMARY OF THE INVENTION

The present invention is directed to a replacement ergonomic adjustable butt stock for a rifle having adjustment for length of pull, weight, drop and cant which may be easily and readily changed in the field during use.

More particularly, the invention resides in a replacement ergonomic adjustable butt stock which mounts on a rifle without modification to the rifle receiver and which does not require modification of the rifle's charging handle.

One object of the present invention is to provide an ergonomic adjustable buttstock assembly which will significantly improve a shooter's marksmanship.

Another object of the present invention is to provide an ergonomic adjustable buttstock for firearms which will significantly reduce muscle tension in a shooter's head, neck, and shoulders.

A further object of the present invention is to provide an ergonomic adjustable gun buttstock for firearms which can be easily and quickly adjusted to custom fit shooters of different size and to fit shooters in different shooting positions without disassembly.

Yet another object of the present invention is to provide an ergonomic adjustable gun buttstock for firearms which does not require modification of the gun receiver assembly to allow for the mounting of said gun buttstock and for use of the so modified gun.

Still another object of the present invention is to provide an ergonomic adjustable gun buttstock for firearms which allows for easy and rapid weight changes to provide for proper balance of the gun under all shooting conditions.

Yet still another object of the present invention is to provide an ergonomic adjustable gun buttstock for firearms which allows for changing the positions and style of cheek piece to suit the shooter and/or shooting event.

According to a further aspect of the present invention there is provided an ergonomic adjustable gun stock for AR-15, M-16, and SR-25 type rifles for use in competition shooting events, having multiple cheek pieces, and adjustable length of pull, weight, drop, and cant comprising, in combination: a butt assembly comprising: a pair of repositionable mating serrated butt plates, a length of pull adjustment rod, a length of pull adjustment rod mounting sleeve, and a butt assembly mounting plate; a weight hanger and at least one removable, repositionable weight; a stock tube assembly comprising: a outer stock extension tube, and an inner stock extension tube wherein an anti-rotational pin passes through the proximal end of said inner stock extension tube and is detachably mounted to a rifle receiver; and a cheek piece mountable on said outer stock extension tube and secured in a desired location by a position locking wheel.

According to another aspect of the present invention there is provided an ergonomic adjustable gun stock for AR-15, M-16, and SR-25 type rifles for use in competition shooting events, having multiple cheek pieces, and adjustable length of pull, weight, drop, and cant comprising, in combination: a butt assembly comprising: a butt end plate, a pair of repositionable mating serrated butt plates, a butt assembly back mounting plate, a spacer plate, a length of pull adjustment rod, a length of pull adjustment rod mounting sleeve, and a butt assembly mounting plate; a weight hanger and at least one removable, repositionable weight; a stock tube assembly comprising: a outer stock extension tube having a nose cap on the outer stock extension tube proximal end wherein an anti-rotational pin passes through said nose cap on said proximal end of said outer stock extension tube, and an inner stock extension tube and is detachably mounted to a rifle receiver by thread means at the proximal end of said inner stock extension tube, further having a flange around the outer surface of said inner stock extension tube located substantially immediately distal to said thread means, yet further having a closed distal end of said inner stock extension tube; and a cheek piece mountable on said outer stock extension tube and secured in a desired location by a position locking wheel.

Beneficial effects of the present invention include easy mounting of the gun buttstock, elimination of head, neck, and shoulder strain, and quick easy fitting of the gun buttstock to any shooter and any shooting position.

A complete understanding of the present invention may be obtained from the drawings and detailed description that follow.

BEST MODE FOR CARRYING OUT THE INVENTION

Figure 1:
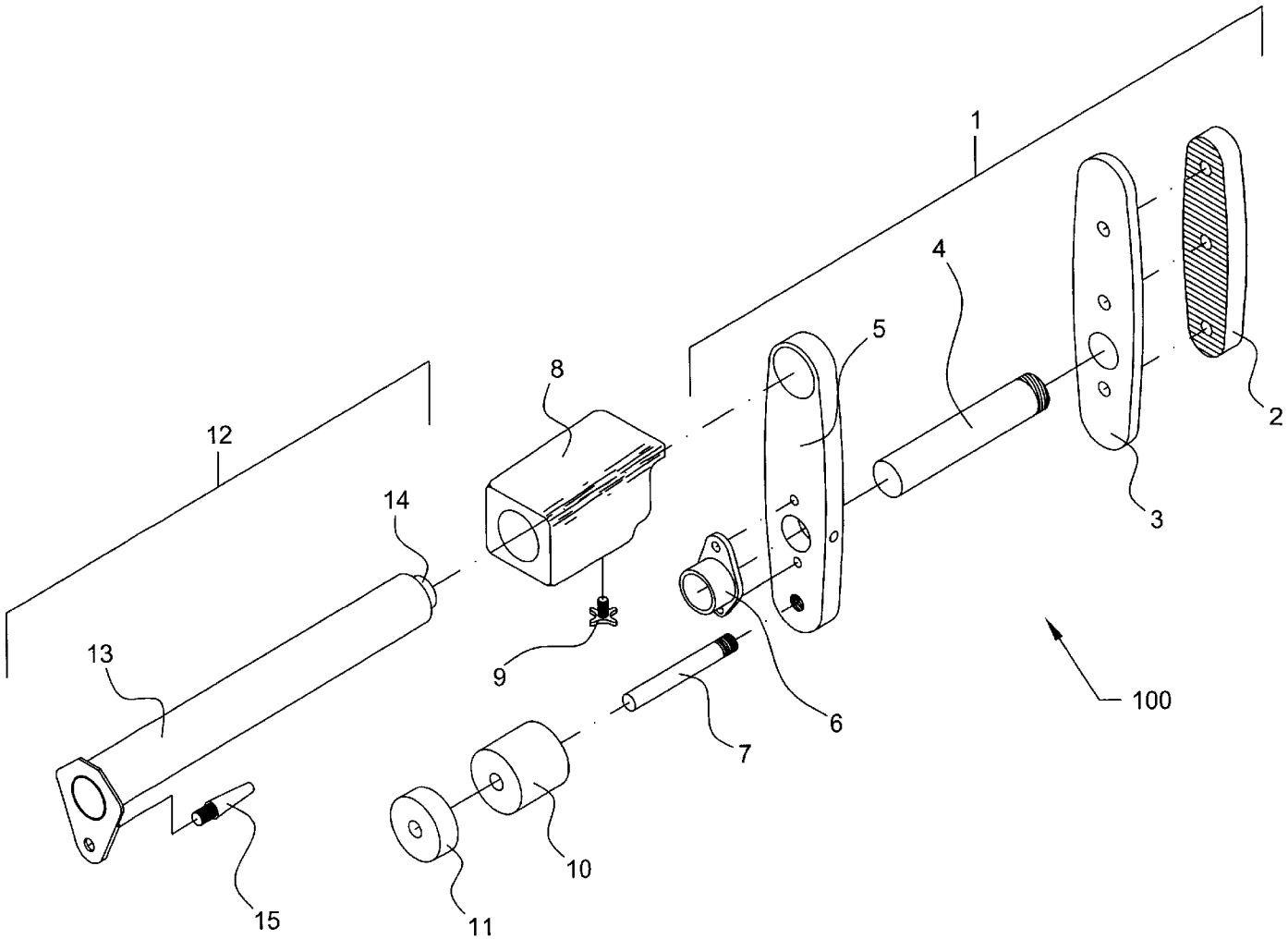
FIG. 1 shows an exploded perspective view of one preferred form of the present invention.

Referring to the drawings by numerals of reference where like numbers represent the same items, there is shown in FIG. 1, the replacement ergonomic butt stock 100 in accordance with the present invention. The replacement ergonomic butt stock 100 of FIG. 1 includes a butt assembly 1 having mating serrated butt plates 2 and 3, length of pull adjustment rod 4, butt assembly mounting plate 5, length of pull adjustment rod mounting sleeve 6. Also attached to the butt assembly mounting plate 5 are weight hanger 7, and removable weights 10 and 11. Stock tube assembly 12 is detachably mounted on butt assembly mounting plate 5 at its distal end and detachably mounted to a rifle receiver (not shown) at its proximal end. Stock tube assembly 12 having outer stock extension tube 13 and inner stock extension tube 14. Anti-rotation pin 15 passes through the proximal end of inner stock extension tube 14 and is detachably mounted to a rifle receiver (not shown). Cheek piece 8 mounts on outer stock extension tube 13 and is secured in the desired position by locking wheel 9.

Figure 2B:
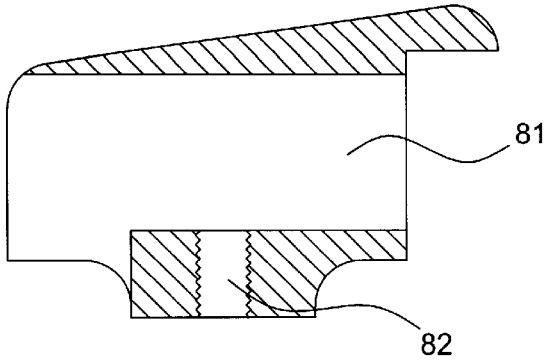
FIG. 2*b* shows a side section view of the cheek piece of FIG. 2*a* through section line A—A.
Figure 2A:
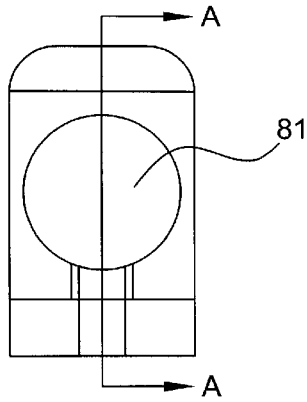
FIG. 2*a* shows an end plan view of one preferred cheek piece of the present invention.

There is shown in FIG. 2*a* an end plan view of one preferred cheek piece 8 having a longitudinal bore 81 for mounting said cheek piece 8 on the outer stock extension tube 13 (FIG. 1).

There is shown in FIG. 2*b* a cross sectional view of one preferred cheek piece 8 through line A—A of FIG. 2*a* having a longitudinal bore 81 for mounting said cheek piece 8 on the outer stock extension tube 13 (FIG. 1) and a threaded bore 82 perpendicular to said longitudinal bore 81 for attaching locking wheel 9 (FIG. 1).

Figure 3B:
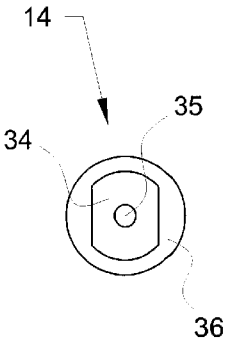
FIG. 3*b* shows an end plan view of the distal end of the inner stock extension tube of FIG. 3*a*.
Figure 3A:
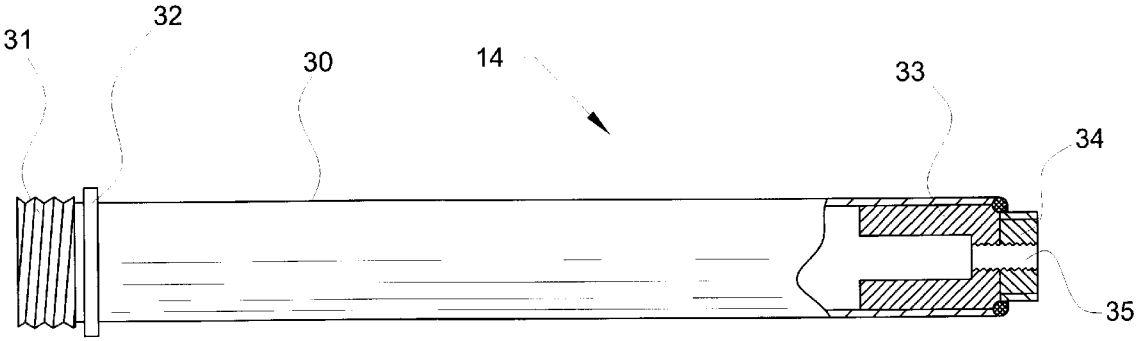
FIG. 3*a* shows a side plan view of one preferred inner stock extension tube of the present invention.

There is shown in FIG. 3*a* a side plan view of the inner stock extension tube 14 having tubular body 30 with a threaded proximal end 31, a flange 32 adjacent thereto, and a distal end having plug 33 permanently attached to said distal end of tubular member 30 by an permanent attachment means 37. Said plug 33 having a outwardly projecting flatted end 34, a threaded bore 35 along the longitudinal axis of and at the distal end of said plug 33 and extending partially through said plug 33, and a larger bore 38 along said same longitudinal axis at proximal end of plug 33 and extending partially thorough said plug 33 and meeting said threaded bore 35.

There is shown in FIG. 3*b* an end plan view of the distal end of plug 33 having a outwardly projecting flatted end 34 adaptable to mounting a wrench for mounting the proximal threaded end of inner stock extension tube 14 (FIG. 3*a*) into a rifle receiver (not shown), the distal end opening of threaded bore 35 and permanent attachment 37. The presently preferred permanent attachment means 37 is welding, most preferably Tig welding.

Figure 4A:
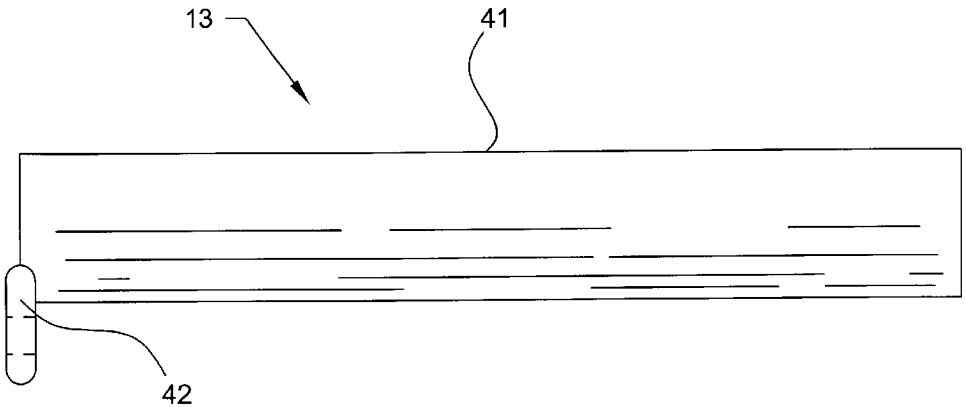
FIG. 4*a* shows a side plan view of one preferred outer stock extension tube of the present invention.

There is shown in FIG. 4*a* a side plan view of the outer stock extension tube 13 having a tubular body 41 with an interior diameter 44 (FIG. 4*b*) large enough to allow for the inner stock extension tube 14 (FIG. 3*a*) to be mounted therein, and on the proximal end of said tubular body 41 a nose cap 42 having a bore 43 for passage of anti-rotation pin 15 (FIG. 1).

Figure 4B:
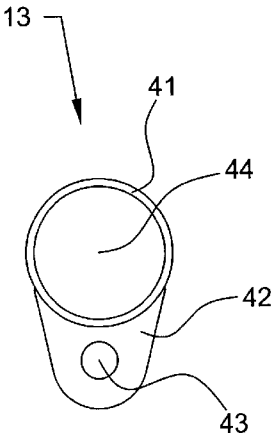
FIG. 4*b* shows an end plan view of the proximal end of the outer stock extension tube of FIG. 4*a*.

As shown the proximal end plan view in FIG. 4*b* a tubular body 41, interior diameter 44 large enough to allow for the inner stock extension tube 14 (FIG. 3*a*) to be mounted therein and nose cap 42 having a bore 43 for passage of anti-rotation pin 15 (FIG. 1).

Figure 5B:
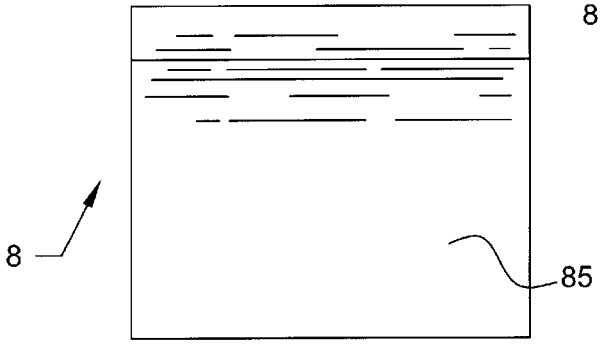
FIG. 5*b* shows a side plan view of the cheek piece of FIG. 5*a*.
Figure 5A:
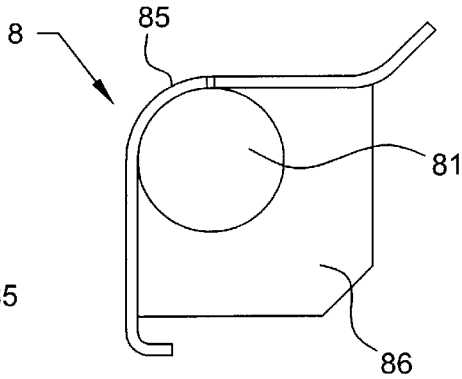
FIG. 5*a* shows an end plan view of another preferred cheek piece of the present invention.

FIG. 5*a* shows an end view of another preferred embodiment of a cheek piece suitable for use in the present invention, having a body 86 containing a bore 81 for mounting on the outer stock extension tube and a working surface 85 upon which the shooter's cheek rests. The cheek piece body 86 is preferably made of aluminum but may be made from other metals as well as from polymers, composites, and engineered materials. Further, the cheek piece body 86 and the cheek piece working surface 85 may be made of the same material or different materials and permanently attached to one another by any suitable known means.

FIG. 5*b* shows a side plan view of the preferred cheek piece of FIG. 5*a* showing the working surface 85. Preferably the working surface 85 is made of sheet aluminum; however it is to be understood that other metals and other materials such as polymers and engineered materials may also be used.

Figure 6A:
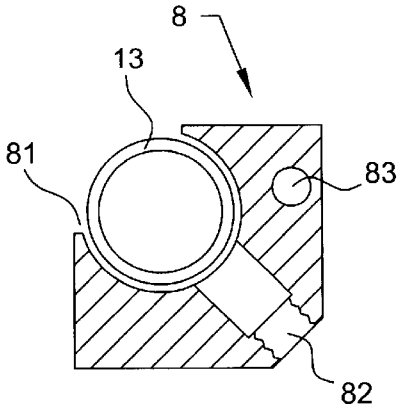
FIG. 6*a* shows an end section view of yet another preferred cheek piece of FIG. 6*b* through section line B—B.
Figure 6B:
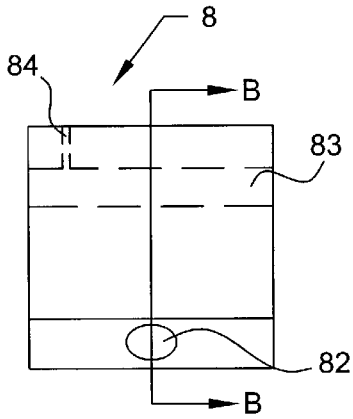

FIG. 6*a* shows and end sectional view of yet another preferred cheek piece 8 through lines B—B of FIG. 6*b*. Also shown is the outer stock extension tube 13 mounted in mounting bore 81 of cheek piece 8 and locked in position by an Allen head set screw (not shown) mounted in threaded bore 82. The mounting bore 81 is created off of the center longitudinal axis of cheek piece 8 so as to create an eccentric movement of cheek piece 8 as it is rotated around outer stock extension tube 13. This allows for both rotational location and distance between the outer stock extension tube 13 and the outer working surface of cheek piece 8. FIG. 6*a* also shows a hole 83 which is lined with a plastic sleeve (not shown) for holding an Allen wrench (not shown) for making adjustments to the various adjustable portions of the invention.

FIG. 6*b* shows a side plan view of the cheek piece of FIG. 6*a* having a mounting bore 81, a cheek piece locking bore 82, an Allen wrench retaining bore 83 and tension adjusting threaded bore 84, and a working surface 85.

Figure 7:
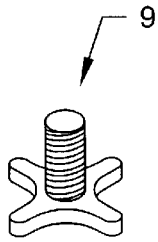
FIG. 7 shows a perspective view of the locking wheel screw.

Shown in FIG. 7 is a perspective view of a preferred locking wheel used to hold a cheek piece 8 in position on outer stock extension tube 13.

Figure 8C:
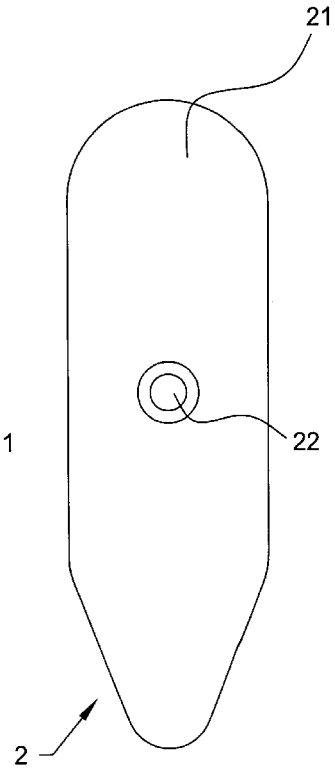
FIG. 8*c* shows a rear plan view of one preferred embodiment of the rear mating serrated butt plate of FIG. 8*a*.
Figure 8A:
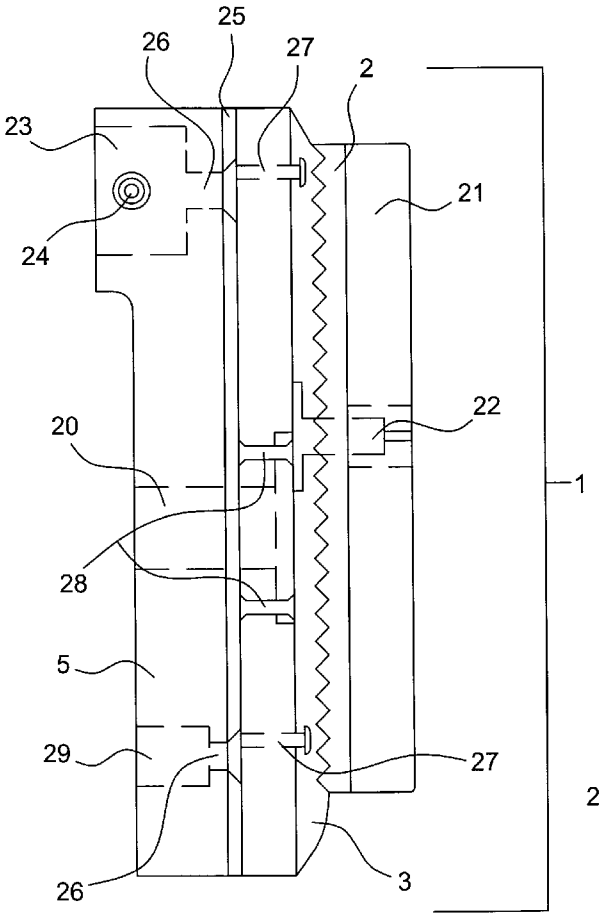
FIG. 8*a* shows a side plan view of one preferred embodiment of the butt plate assembly.

Shown in FIG. 8*a* is a side plan view of one particularly preferred butt stock assembly having a rear butt plate 21, a rear mating serrated butt plate 2, a front mating serrated butt plate 3, an ornamental separation plate 25, and a butt assembly mounting plate 5. Rear but plate 21 is shown with bore 22 for mounting said rear butt plate 21 to rear mating serrated butt plate 2 and to the front mating butt plate 3 using a suitable attaching means (not shown). Front mating butt plate 3 further shows attaching means 27 for attaching said front mating butt plate 3 to ornamental separation plate 25 and butt assembly mounting plate 5. The butt assembly mounting plate 5 further showing bore 23 for receiving the distal end of inner stock extension tube 14, further having a threaded bore 24 to allow for locking the butt plate assembly and preventing rotation of same using a threaded Allen head screw (not shown). Also shown are bore 20 for the length of pull rod 4 to travel in and holes 31 for fixedly mounting length of pull mounting sleeve 6 to butt assembly mounting plate 5. Further shown are threaded bore 29 for attaching the weight hanger 7 to butt assembly mounting plate 5 and screw hole 26 for further attaching the weight hanger 7 to said mounting plate 5. Said ornamental separation plate 25 is made of a material with a color contrasting or complimenting the color of the rest of the butt stock assembly. Preferably the ornamental separation plate is made of brass, but it can be made of any metal, polymer, or engineered material as desired for visual effect. It is to be further understood that the ornamental separation plate is not necessary to realize the present invention or its benefits.

Figure 8B:
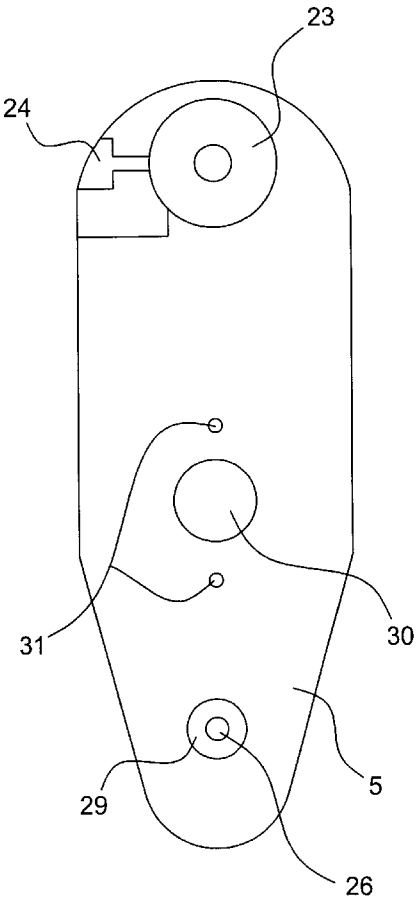
FIG. 8*b* shows a front plan view of the butt assembly mounting plate of FIG. 8*a*.

Shown in FIG. 8*b* is a front plan view of the butt assembly mounting plate 5 having a bore 23 for receiving the distal end of inner stock extension tube 14, further having a threaded bore 24 to allow for locking the butt plate assembly and preventing rotation of same using a threaded Allen head screw (not shown). Also shown are bore 20 for the length of pull rod 4 to travel in and holes 31 for fixedly mounting length of pull mounting sleeve 6 to butt assembly mounting plate 5. Further shown are threaded bore 29 for attaching the weight hanger 7 to butt assembly mounting plate 5 and screw hole 26 for further attaching the weight hanger 7 to said mounting plate 5.

FIG. 8*c* shows a rear plan view of the rear butt plate 21 and bore 22 for mounting said rear butt plate 21 to rear mating serrated butt plate 2 and to the front mating butt plate 3 using a suitable attaching means (not shown).

Figure 9:
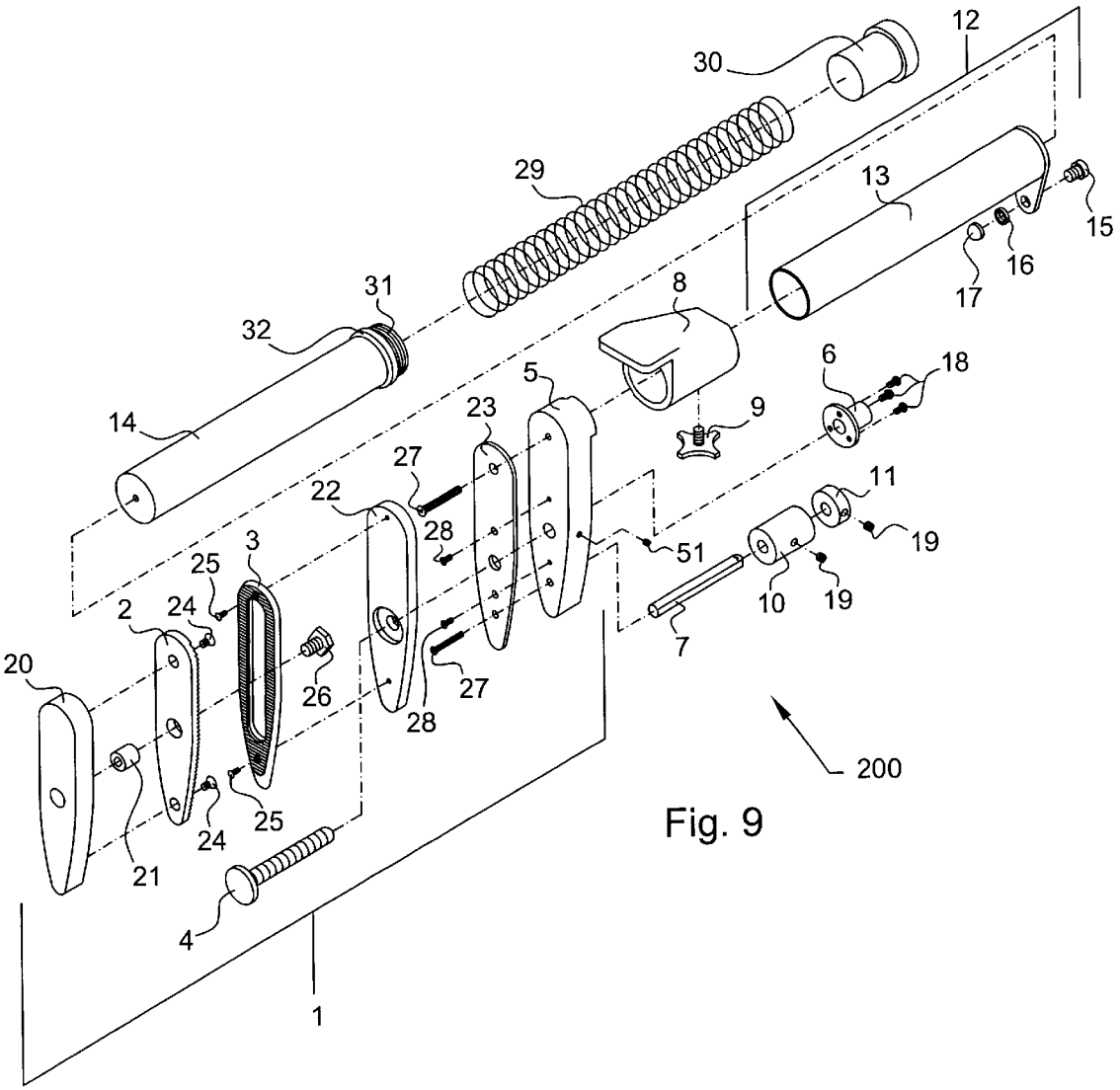
FIG. 9 shows an exploded perspective view of a presently preferred embodiment of the present invention.

There is shown in FIG. 9, another preferred replacement ergonomic butt stock 200 in accordance with the present invention. The replacement ergonomic butt stock 200 of FIG. 9 includes a butt assembly 1 having mating serrated butt plates 2 and 3, butt end plate 20, length of pull adjustment rod 4, butt assembly mounting plate 5, located between serrated butt plate 3 and butt assembly mounting plate 5 are located spacer plate 23 and butt assembly back mounting plate 22. Also attached to the butt assembly mounting plate 5 are length of pull adjustment rod mounting sleeve 6, weight hanger 7, and removable weights 10 and 11. The removable weights 10 and 11 are locked at their respective desired positions by locking means 19. Length of pull adjustment rod mounting sleeve 6 is attached to butt assembly mounting plate 5 by plurality of attaching means 18. Spacer plate 23 is attached to butt assembly mounting plate 5 by pluralities of attaching means 27 and 28. Weight hanger 7 is also mounted to butt assembly mounting plate 5 by one of attaching means 27. The butt assembly back mounting plate is positionally adjustably mounted to butt assembly mounting plate 5 and spacer plate 23 by length of pull adjustment rod 4. Length of pull adjustment rod 4 is rotationally locked by rotational locking means 51. Serrated butt plate 3 is fixedly mounted to butt assembly back mounting plate 22 by a plurality of mounting means 25. Serrated butt plate 3 has a elongated slot centered along its lengthwise axis through which is moveably mounted butt end plate mounting means 26. Serrated butt plate 2 is fixedly attached to butt end plate 20 by means of a plurality of attaching means 24. serrated butt plate 2 has a bore located therein such that end plate mounting means 26 may pass through serrated butt plate 2 and engage butt end plate locking collar 21, said bore being of a diameter that allows passage of end plate mounting means 26 but does not allow passage of butt end plate locking collar 21. Butt end plate 20 has a corresponding bore having a opening on its face mounting to said serrated butt plate 2 being large enough to accept butt end plate locking collar 21 and which has an opening on the opposite face being small enough to prevent said butt end plate locking collar 21 from passing through but large enough for a locking adjustment tool to pass through and into said butt plate locking collar 21.

Stock tube assembly 12 is detachably mounted on butt assembly mounting plate 5 at its distal end and detachably mounted to a rifle receiver (not shown) at its proximal end. Stock tube assembly 12 having outer stock extension tube 13 and inner stock extension tube 14. Anti-rotation pin 15 passes through a nose cap 42 (FIG. 4*a*) at the proximal end of outer stock extension tube 13 and secured to and is detachably mounted to said nose cap 42 (FIG. 4*a*) by attaching means 16 and 17. Cheek piece 8 mounts on outer stock extension tube 13 and is secured in the desired position by locking wheel 9. Inner stock extension tube 14 has a closed distal end (FIG. 3*a*) for mounting to butt assembly mounting plate 5 and to contain the bolt return spring 29, and a threaded proximal end having a thread 31 that is used to screw mount the invention to the rear of the rifle (not shown) using the factory provided buttstock mounting means without need of alteration. Located immediately behind said thread 31 is collar 32 which seats the inner stock extension tube 14 at is fully inserted position within outer stock extension tube 13. Also shown is bolt return spring 29 and bolt return spring end plug 30.

The currently preferred fixedly attaching means are rivets or welding, however, other known fixedly attaching means such as screws, and the like may be used by those skilled in the art and are to be considered within the scope of the present invention. The currently preferred means of removably attaching means is Allen head screws; however, other types of screws and other suitable removably attaching means known to those skilled in the art are to be considered within the scope of the present invention.

In a preferred embodiment, the stock tube assembly 12, the butt plate assembly 10, and the cheek piece 8 are made of aluminum. The cheek piece 8 may also be constructed of various polymers, steel, and engineered materials such as, for example, resin filled graphite. The weights 10 and 11 may be made of appropriately dense metals, preferably steel, copper, or brass. Likewise the weights 10 and 11 may be made of the same metal or different metals. The presently preferred material for the tubular members 13 and 14 is 6061 aluminum; however any suitable tubular metal or engineered material may be used.

In practice the original butt stock is removed from the rifle, the inner stock extension tube proximal threaded end is screwed into the original threaded bore on the rear of the rifle receiver and tightened using an appropriate wrench and the flatted plug end 34. The anti-rotation pin 15 is then passed through the bore 43 of nose cap 42 and attached and locks the detent spring in original rifle lower receiver. The outer stock extension tube 13 is then mounted over the inner stock extension tube 14, the cheek piece 8 is mounted on the outer stock extension tube 13, and the distal end of the inner stock extension tube is attached to the butt assembly mounting plate 5 using a threaded attachment means thorough the butt assembly mounting plate 5 and into the threaded bore 35 of distal end plug 33.

It is to be further understood that various combinations of foam introduction and foaming may be combined as desired to form seat cushion structures that have a set of desired foam density profiles.

Although the preferred embodiments of the present invention have been disclosed, various changes and modifications may be made without departing from the scope of the invention as set forth in the appended claims.

What is claimed is:

1. An ergonomic adjustable gun stock for AR-15, M-16, and SR-25 type rifles for use in competition shooting events, having multiple cheek pieces, and adjustable length of pull, weight, drop, and cant comprising, in combination:

a butt assembly comprising: a pair of repositionable mating serrated butt plates, a length of pull adjustment rod, a length of pull adjustment rod mounting sleeve, and a butt assembly mounting plate;

a weight hanger and at least one removable, repositionable weight;

a stock tube assembly comprising: a outer stock extension tube, and an inner stock extension tube wherein an anti-rotational pin passes through the proximal end of said inner stock extension tube and is detachably mounted to a rifle receiver; and a cheek piece mountable on said outer stock extension tube and secured in a desired location by a position locking wheel.

2. An ergonomic adjustable gun stock for AR-15, M-16, and SR-25 type rifles for use in competition shooting events as claimed in claim 1 wherein, said adjustable gun stock is composed of one or more materials selected from the group consisting essentially of aluminum, steel, brass, polymer, engineered material, and combinations thereof.

3. An ergonomic adjustable gun stock for AR-15, M-16, and SR-25 type rifles for use in competition shooting events as claimed in claim 1 wherein, the cheek piece outer surface is covered in a material providing a comfortable surface for a shooters face.

4. An ergonomic adjustable gun stock for AR-15, M-16, and SR-25 type rifles for use in competition shooting events as claimed in claim 1 wherein, said cheek piece has a means of storing an ergonomic adjustable gun stock adjustment tool.

5. An ergonomic adjustable gun stock for AR-15, M-16, and SR-25 type rifles for use in competition shooting events, having multiple cheek pieces, and adjustable length of pull, weight, drop, and cant comprising, in combination:

a butt assembly comprising: a butt end plate, a pair of repositionable mating serrated butt plates, a butt assembly back mounting plate, a spacer plate, a length of pull adjustment rod, a length of pull adjustment rod mounting sleeve, and a butt assembly mounting plate;

a weight hanger and at least one removable, repositionable weight;

a stock tube assembly comprising: a outer stock extension tube having a nose cap on the outer stock extension tube proximal end wherein an anti-rotational pin passes through said nose cap on said proximal end of said outer stock extension tube, and an inner stock extension tube and is detachably mounted to a rifle receiver by thread means at the proximal end of said inner stock extension tube, further having a flange around the outer surface of said inner stock extension tube located substantially immediately distal to said thread means, yet further having a closed distal end of said inner stock extension tube; and a cheek piece mountable on said outer stock extension tube and secured in a desired location by a position locking wheel.

6. An ergonomic adjustable gun stock for AR-15, M-16, and SR-25 type rifles for use in competition shooting events as claimed in claim 5 wherein, said adjustable gun stock is composed of one or more materials selected from the group consisting essentially of aluminum, steel, brass, polymer, engineered material, and combinations thereof.

7. An ergonomic adjustable gun stock for AR-15, M-16, and SR-25 type rifles for use in competition shooting events as claimed in claim 5 wherein, the cheek piece outer surface is covered in a material providing a comfortable surface for a shooters face.

8. An ergonomic adjustable gun stock for AR-15, M-16, and SR-25 type rifles for use in competition shooting events as claimed in claim 5 wherein, said cheek piece has a means of storing an ergonomic adjustable gun stock adjustment tool.

* * * * *